US011245987B2

(12) United States Patent
Huang

(10) Patent No.: US 11,245,987 B2
(45) Date of Patent: Feb. 8, 2022

(54) MICRO-SPEAKER

(71) Applicant: LUXSHARE-ICT CO., LTD., Taipei (TW)

(72) Inventor: Jiin-Tarng Huang, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 0 days.

(21) Appl. No.: 16/787,922

(22) Filed: Feb. 11, 2020

(65) Prior Publication Data

US 2021/0120342 A1 Apr. 22, 2021

(30) Foreign Application Priority Data

Oct. 17, 2019 (TW) ..... 108137564

(51) Int. Cl.

| | |
|---|---|
| ***H04R 9/06*** | (2006.01) |
| ***H04R 9/04*** | (2006.01) |
| ***H04R 31/00*** | (2006.01) |
| ***H04R 7/04*** | (2006.01) |
| ***H04R 7/18*** | (2006.01) |

(52) U.S. Cl.

CPC ..... *H04R 9/06* (2013.01); *H04R 7/04* (2013.01); *H04R 7/18* (2013.01); *H04R 9/043* (2013.01); *H04R 9/047* (2013.01); *H04R 31/006* (2013.01); *H04R 2400/03* (2013.01); *H04R 2400/07* (2013.01)

(58) Field of Classification Search

CPC . H04R 7/12; H04R 7/18; H04R 9/043; H04R 9/046; H04R 9/06; H04R 11/02; H04R 2400/03; H04R 2400/07; H04R 2400/11; H04R 7/04; H04R 9/047; H04R 31/006

See application file for complete search history.

(56) References Cited

U.S. PATENT DOCUMENTS

| | | | | |
|---|---|---|---|---|
| 9,185,494 | B2 * | 11/2015 | Choi | H04R 9/043 |
| 2018/0302724 | A1 * | 10/2018 | Li | H04R 7/12 |
| 2020/0045453 | A1 * | 2/2020 | Xiao | H04R 9/046 |
| 2020/0314576 | A1 * | 10/2020 | Hu | H04R 7/12 |

FOREIGN PATENT DOCUMENTS

| | | | |
|---|---|---|---|
| CN | 102611989 | A | 7/2012 |
| EP | 2 448 291 | A1 | 5/2012 |
| TW | M530503 | U | 10/2016 |
| TW | 201808018 | A | 3/2018 |
| TW | I618420 | B | 3/2018 |

* cited by examiner

*Primary Examiner* — Huyen D Le

(74) *Attorney, Agent, or Firm* — Birch, Stewart, Kolasch & Birch, LLP

(57) ABSTRACT

The micro-speaker includes a hollow frame, a diaphragm, a voice coil, an elastic damping piece, and a magnetic circuit assembly. The hollow frame includes a hollow portion, a top surface, and a bottom surface. The diaphragm includes a central portion and an outer peripheral portion surrounding the central portion. The voice coil is coaxially held in the hollow portion. The voice coil includes a top edge fixedly connected to the central portion and a bottom edge. The elastic damping piece includes an outer fixing member connected to the hollow frame, an inner fixing member connected to the voice coil, and an elastic piece body connected between the outer fixing member and the inner fixing member. The magnetic circuit assembly is held in the hollow portion and is in the voice coil but not in contact with the voice coil.

7 Claims, 4 Drawing Sheets

MICRO-SPEAKER

CROSS-REFERENCE TO RELATED APPLICATION

This non-provisional application claims priority under 35 U.S.C. § 119(a) to Patent Application No. 108137564 in Taiwan, R.O.C. on Oct. 17, 2019, the entire contents of which are hereby incorporated by reference.

BACKGROUND

Technical Field

The instant disclosure relates to a speaker, and more particular to a micro-speaker.

Related Art

Because the overall size of the speaker known to the inventor is large and has a long voice coil, an intermediate auxiliary element is provided to fix with the voice coil to make the vibration more stable and make the music more pleasing to the ear. The auxiliary element of the voice coil is usually called spider. In consideration of the overall size and structure, the micro-speaker known to the inventor only has a diaphragm without any elastic damping piece (spider), which can operate stably when the bass is not strong and the power is not large. However, when digital signal processors (DSPs) and intelligent amplifier are widely used, the micro-speaker known to the inventor cannot operate stably, resulting in a nonlinearity condition and generating noise easily.

SUMMARY

In view of this, an embodiment of the instant disclosure provides a micro-speaker. The micro-speaker comprises a hollow frame, a diaphragm, a voice coil, an elastic damping piece, and a magnetic circuit assembly. The hollow frame comprises a hollow portion, a top surface, and a bottom surface opposite to the top surface. The hollow portion communicates between the top surface and the bottom surface. The diaphragm comprises an outer peripheral portion and a central portion. The outer peripheral portion surrounds the central portion and covers the top surface of the hollow frame. The voice coil is coaxially held in the hollow portion of the hollow frame. The voice coil comprises a top edge and a bottom edge opposite to the top edge. The top edge is fixedly connected to the central portion of the diaphragm. The elastic damping piece comprises an outer fixing member, an inner fixing member, and an elastic piece body. The outer fixing member is fixedly connected to the bottom surface of the hollow frame. The inner fixing member is fixedly connected to the bottom edge of the voice coil. The elastic piece body is connected between the outer fixing member and the inner fixing member. The magnetic circuit assembly is held in the hollow portion of the hollow frame. The magnetic circuit assembly is in the voice coil but not in contact with the voice coil.

Therefore, according to one or some embodiments of the instant disclosure, by applying an elastic damping piece at the bottom of the voice coil as a structure for stable vibration, the two ends of the voice coil are respectively attached by the diaphragm and the elastic damping piece, so that the voice coil has a better balance force during the reciprocating movement. Because of the structure formed by the diaphragm and the elastic damping piece for keeping the voice coil straight up-and-down, the vibration of the voice coil can be more stable. Hence, in the case of high power is applied to the micro-speaker, the vibration of the voice coil can be more stable and the vibration can be performed in a linearity condition.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
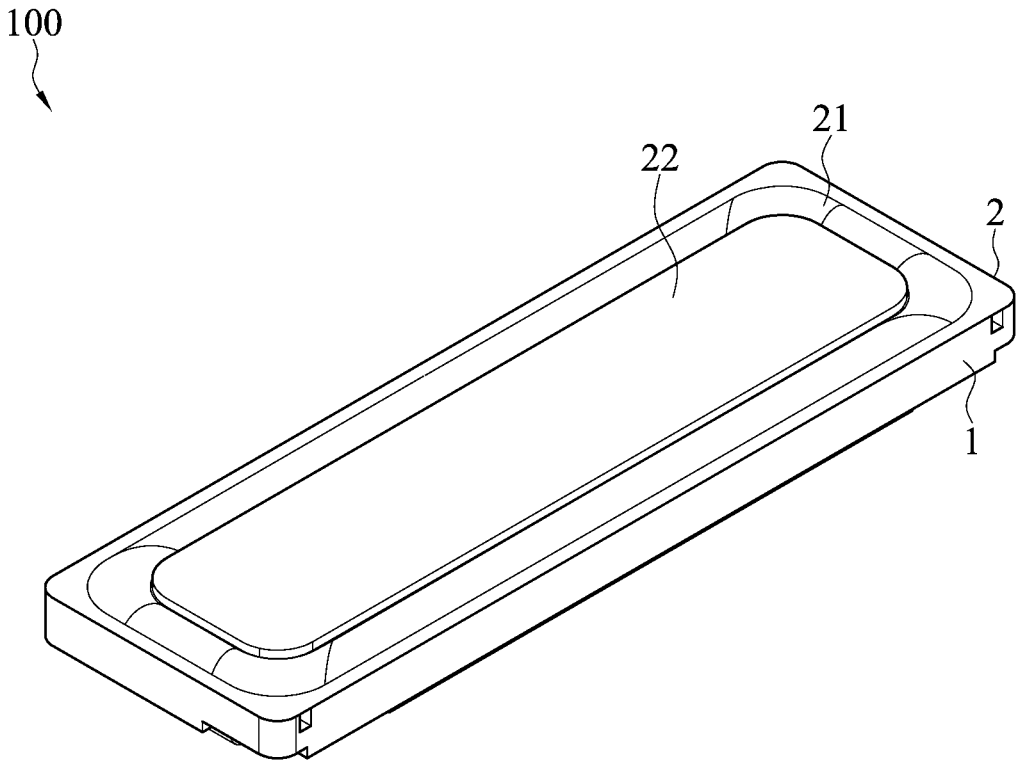
FIG. 1 illustrates a perspective view of a micro-speaker according to an exemplary embodiment of the instant disclosure.
Figure 2:
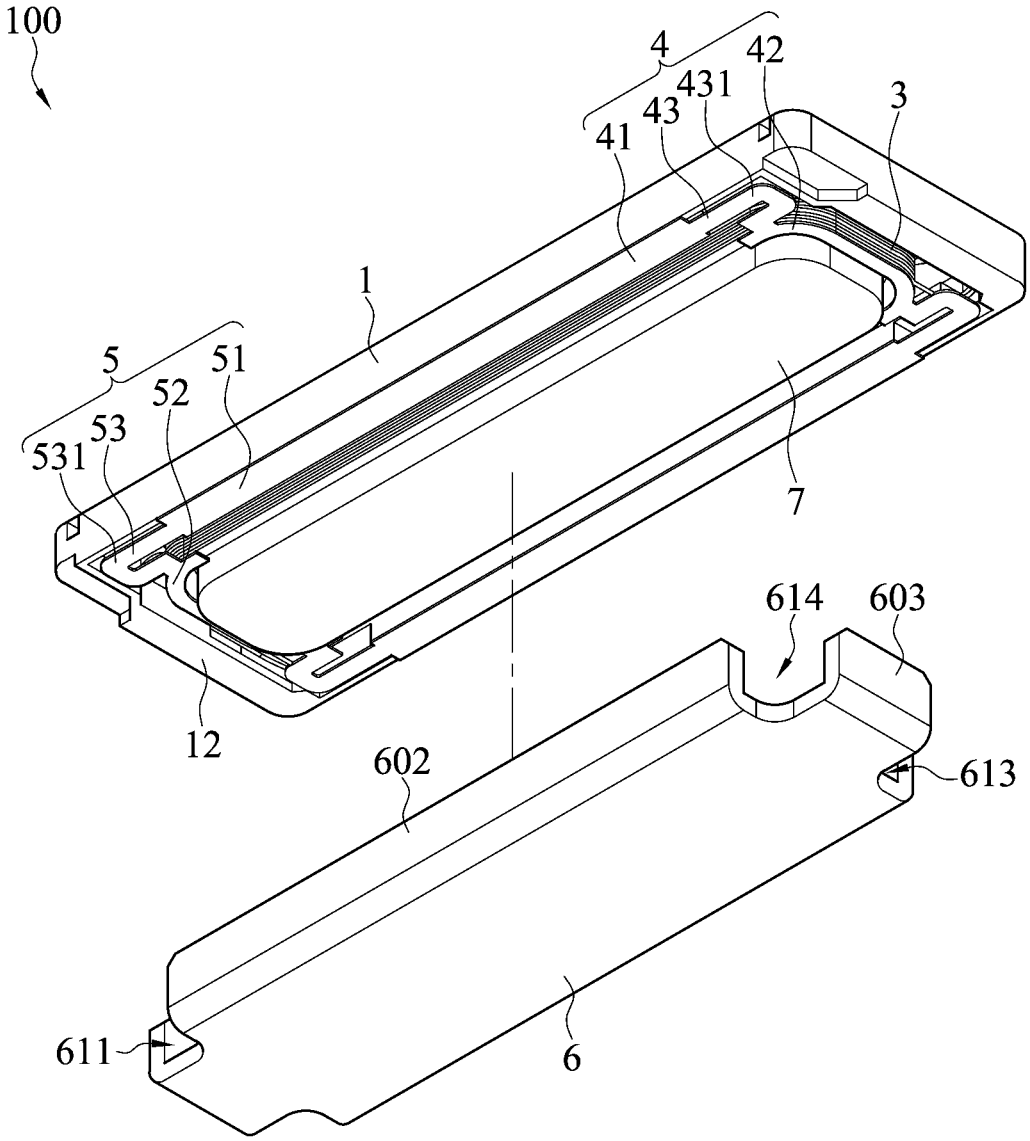
FIG. 2 illustrates a partial exploded bottom view of the micro-speaker of the exemplary embodiment.
Figure 3:
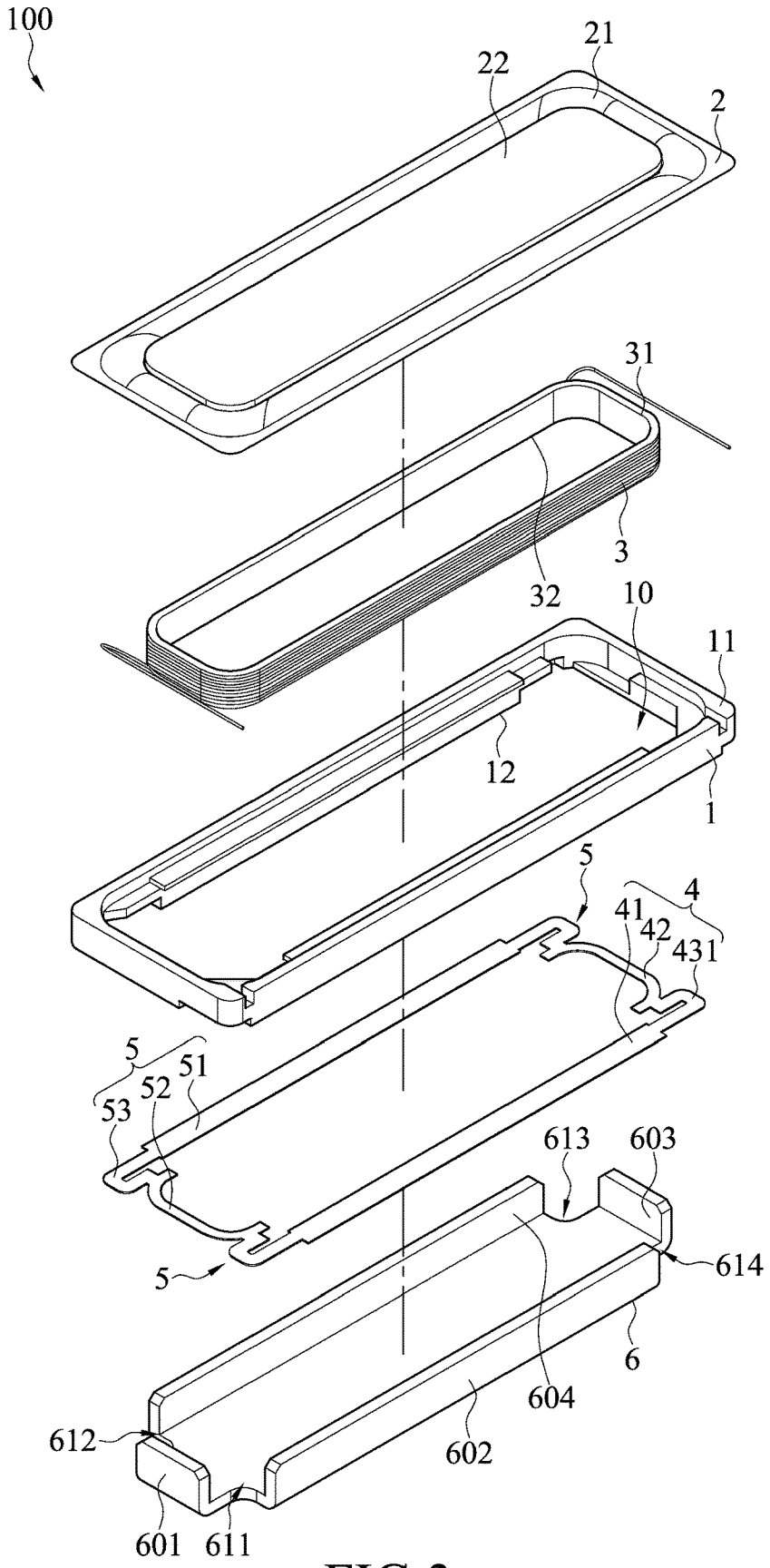
FIG. 3 illustrates an exploded view of the micro-speaker of the exemplary embodiment.
Figure 4:
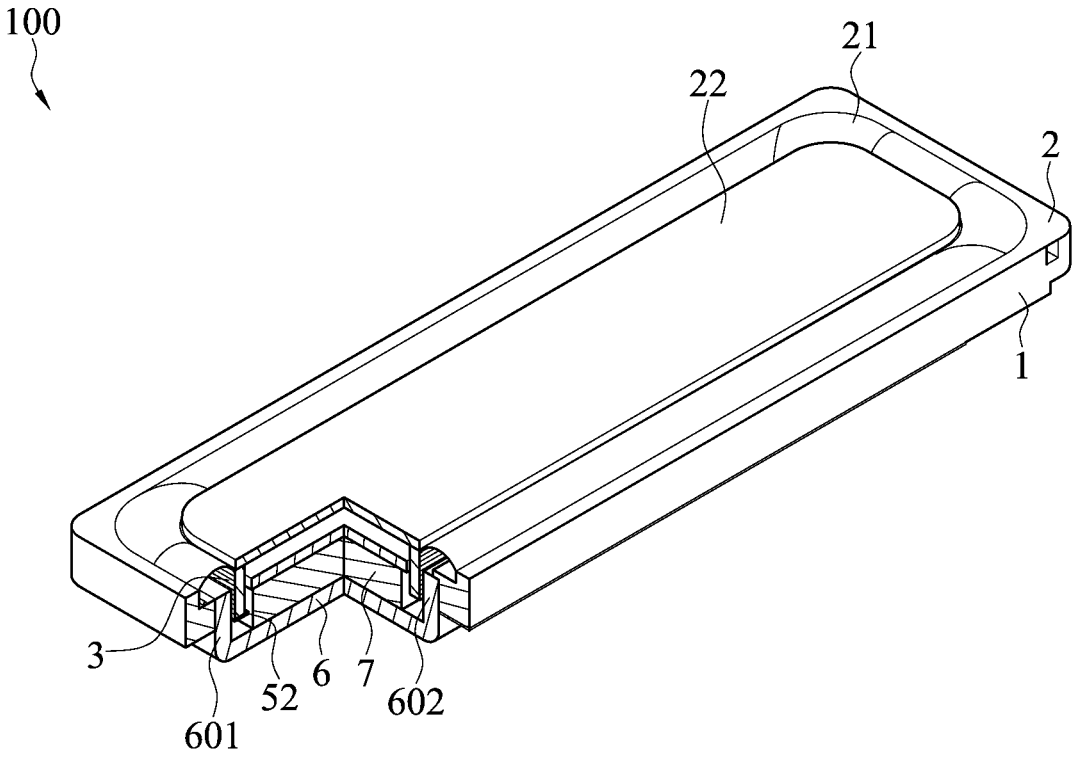
FIG. 4 illustrates a partial sectional view of the micro-speaker of the exemplary embodiment.

Please refer to FIGS. 1 to 4, illustrating a micro-speaker 100 according to an exemplary embodiment of the instant disclosure. FIG. 1 illustrates a perspective view thereof, FIG. 2 illustrates a partial exploded bottom view thereof, FIG. 3 illustrates an exploded view thereof, and FIG. 4 illustrates a partial sectional view thereof. As shown in FIGS. 2 and 3, in this embodiment, the micro-speaker 100 comprises a hollow frame 1, a diaphragm 2, a voice coil 3, an elastic damping piece 4, and a magnetic circuit assembly 7.

Please refer to FIG. 3. The hollow frame 1 comprises a hollow portion 10, a top surface 11, and a bottom surface 12 opposite to the top surface 11. The hollow portion 10 communicates between the top surface 11 and the bottom surface 12. The diaphragm 2 comprises an outer peripheral portion 21 and a central portion 22. The outer peripheral portion 21 surrounds the central portion 22. The outer peripheral portion 21 covers the top surface 11 of the hollow frame 1. The diaphragm 2 may cover the hollow frame 1 by gluing, hot melting, and ultrasonic welding, so that the diaphragm 2 can be connected with the hollow frame 1, and the outer peripheral portion 21 of the diaphragm 2 can be fixed at the top surface 11 of the hollow frame 1.

The voice coil 3 is coaxially held in the hollow portion 10 of the hollow frame 1. The voice coil 3 comprises a top edge 31 and a bottom edge 32 opposite to the top edge 31. The top edge 31 is fixedly connected to the central portion 22 of the diaphragm 2. As shown in FIG. 2, the magnetic circuit assembly 7 is held in the hollow portion 10 of the hollow frame 1. The magnetic circuit assembly 7 is in the voice coil 3 but not in contact with the voice coil 3.

Please refer to FIGS. 2 and 3. The elastic damping piece 4 comprises an outer fixing member 41, an inner fixing member 42, and an elastic piece body 43. The outer fixing member 41 is fixedly connected to the bottom surface 12 of the hollow frame 1. The inner fixing member 42 is fixedly connected to the bottom edge 32 of the voice coil 3. The elastic piece body 43 is connected between the outer fixing member 41 and the inner fixing member 42.

Therefore, according to one or some embodiments of the instant disclosure, by applying the elastic damping piece 4 at the bottom edge 32 of the voice coil 3 as a structure for stable vibration, the two ends of the voice coil 3 are respectively attached by the diaphragm 2 and the elastic damping piece 4, so that the voice coil 3 has a better balance force in reciprocating movement. Because of the structure formed by the diaphragm 2 and the elastic damping piece 4 for keeping the voice coil 3 straight up-and-down, the vibration of the voice coil 3 can be more stable, Hence, in the case of high power is applied to the micro-speaker 100, the vibration of the voice coil 3 can be more stable and the vibration can be performed in a linearity condition.

The elastic damping piece 4 mentioned above may be provided as a set held in any corner, as long as the outer fixing member 41 and the inner fixing member 42 are respectively and fixedly connected to the bottom surface 12 of the hollow frame 1 and the bottom edge 32 of the voice coil 3. By fixing the outer fixing member 41 of the elastic damping piece 4 at the hollow frame 1 which is fixed, the inner fixing member 42 is fixed at the voice coil 3 which vibrates back-and-forth. Hence, the elastic piece body 43 connected between the outer fixing member 41 and the inner fixing member 42 can provide the damping effect when the inner fixing member 42 vibrates back-and-forth with the voice coil 3, thereby facilitating the vibration of the voice coil 3 to be more stable.

In order to make the damping effect of the voice coil 3 be more balanced and stable, and keep the voice coil 3 in a coaxial back-and-forth movement with the diaphragm 2 without deflection, in this embodiment, the micro-speaker 100 further comprises a symmetrical damping piece 5. The symmetrical damping piece 5 is arranged at one end of the hollow frame 1 symmetrically opposite to the elastic damping piece 4. As shown in FIG. 3, in this embodiment, because the diaphragm 2 is rectangular, the hollow frame 1 is a rectangular frame corresponding to the diaphragm 2, and the voice coil 3 is rectangular, correspondingly. In other embodiments, the hollow frame 1 may be a circular frame, and the diaphragm 2 and the voice coil 3 are circular structures, correspondingly.

In this embodiment, the elastic damping piece 4 is held in one of the corners of the rectangular hollow frame 1. Although a single elastic damping piece 4 is enough to provide the damping effect to the voice coil 3, one or more sets of the symmetrical damping piece 5 may be configured for providing a more stable and balanced damping effect to the voice coil 3.

For example, the symmetrical damping piece 5 is held in the diagonal corner of the elastic damping piece 4, or the symmetrical damping piece 5 is held in the neighboring corner of the elastic damping piece 4. In this embodiment, the elastic damping piece 4 is held in one of the four corners of the rectangular hollow frame 1, and three symmetrical damping pieces 5 are held in the rest of three corners of the rectangular hollow frame 1. The symmetrical damping piece 5 comprises an outer end 51, an inner end 52, and a damping piece body 53. The outer end 51 is fixedly connected to the bottom surface 12 of the hollow frame 1. The inner end 52 is fixedly connected to the bottom edge 32 of the voice coil 3. The damping piece body 43 is connected between the outer end 51 and the inner end 52.

The structures of the elastic damping piece 4 and the symmetrical damping piece 5 may be the same or similar. The connection between parts of the elastic damping piece 4 and the connection between parts of the symmetrical damping piece 5 are similar. The outer end 51 is fixedly connected to the bottom surface 12 of the hollow frame 1, and the inner end 52 is fixedly connected to the bottom edge 32 of the voice coil 3. That is, the outer end 51 and the inner end 52 of the symmetrical damping piece 5 are respectively and fixedly connected to the bottom surface 12 of the hollow frame 1 and the bottom edge 32 of the voice coil 3. Hence, the symmetrical damping piece 5 can provide the damping effect when vibrating back-and-forth with the voice coil 3, facilitating the vibration of the voice coil 3 to be more stable. In other words, the elastic damping pieces 4 or the symmetrical damping pieces 5 are held in the four corners to provide the voice coil 3 with a better balanced force when the voice coil 3 is in the reciprocating movement. Furthermore, when the diaphragm 2 is driven up and down by the voice coil 3, the elastic damping piece 4 (or the symmetrical damping piece 5) keeps the voice coil 3 in a coaxial back-and-forth movement with the diaphragm 2 without deflection.

Please refer to FIG. 3. In this embodiment, furthermore, the three symmetrical damping pieces 5 are the first symmetrical damping pieces (see FIG. 3 as the lowest of the three symmetrical damping pieces 5) and the second symmetrical damping pieces (see FIG. 3 as the leftmost of the three symmetrical damping pieces 5) and the third symmetrical damping pieces (see FIG. 3 as the uppermost of the three symmetrical damping pieces 5).The three symmetrical damping pieces 5 and the elastic damping piece 4 are integrally connected as a one- piece annular structure. The first symmetrical damping piece comprises a first outer end, a first inner end, and a first damping piece body; the first outer end is fixedly connected to the bottom surface of the hollow frame, the first inner end is fixedly connected to the bottom edge of the voice coil, and the first damping piece body is connected between the first outer end and the first inner end. The second symmetrical damping piece comprises a second outer end, a second inner end, and a second damping piece body; the second outer end is fixedly connected to the bottom surface of the hollow frame, the second inner end is fixedly connected to the bottom edge of the voice coil, and the second damping piece body is connected between the second outer end and the second inner end. The third symmetrical damping piece comprises a third outer end, a third inner end, and a third damping piece body; the third outer end is fixedly connected to the bottom surface of the hollow frame, the third inner end is fixedly connected to the bottom edge of the voice coil, and the third damping piece body is connected between the third outer end and the third inner end. The first outer end is connected to the outer fixing member, the first inner end is connected the second inner end, the second outer end is connected the third outer end, the third inner end is connected inner fixing member, wherein the inner fixing member is not connected the first inner end, the second inner end is not connected the third inner end, so that the first symmetrical damping piece, the second symmetrical damping piece, the third symmetrical damping piece and the elastic damping piece are connected as a single annular structure. In other embodiments, the symmetrical damping pieces 5 and the elastic damping piece 4 are not connected with each other to form a one-piece structure; instead, are configured on the hollow frame 1 separately. Conversely, as similar to the configuration in the present embodiment, the symmetrical damping piece 5 and the elastic damping piece 4 may be integrally connected as a single annular structure. The one-piece annular structure allows the symmetrical damping piece 5 and the elastic damping piece 4 to be set at four corners in a one-step procedure in manufacturing or assembling. There is no need of manufacturing and assembling the damping components one by one, thereby reducing the number of the components to be manufactured, the number of the steps in the assembly process, and working hours.

Please refer to FIGS. 2 and 3. The elastic piece body 43 of the elastic damping piece 4 comprises a bending portion 431. An extension length of the bending portion 431 is greater than a linear distance between the outer fixing member 41 and the inner fixing member 42. In this embodiment, the bending portion 431 is a U-shaped elastic piece body. In other embodiments, the bending portion 431 is an elastic piece body of S-shaped, arc shaped, etc. Accordingly, the bending portion 431 suspended in the air and having a certain amount of deformation can provide a good elastic deformation margin during the voice coil 3 being in the up-and-down reciprocating movement.

Similarly, the damping piece body 53 of the symmetrical damping piece 5 may also comprise a bending portion 531. An extension length of the bending portion 531 is greater than a linear distance between the outer end 51 and the inner end 52. In this embodiment, the bending portion 531 is a U-shaped elastic piece body, but embodiments are not limited thereto. The bending portion 531 is an elastic piece body of S-shaped, arc shaped, etc., as long as the bending portion 531 is of a shape capable of providing an elastic force.

It is worth noting that from FIG. 3 and the above description, the bending portion 431 and the bending portion 531 are all planar, so that the whole structure of the elastic damping piece 4 and whole structure of the symmetrical damping piece 5 are all planar. Therefore, when the elastic damping piece 4 and the symmetrical damping pieces 5 are connected as a one-piece annular structure, the whole annular structure is also planar. Because of the planar structure, it is convenient in manufacturing that the one-piece structure formed by the elastic damping piece 4 and the symmetrical damping pieces 5 can be formed in a one-time stamping process. Moreover, because of the overall planar, annular structure, the one-piece structure formed by the elastic damping piece 4 and the symmetrical damping pieces 5 can be connected to the bottom of the hollow frame 1 and the voice coil 3 through a simple attachment procedure, so that the assembly of the symmetrical damping pieces 5 and the elastic damping piece 4 with the hollow frame 1 is faster.

Additionally, the outer fixing member 41 of the elastic damping piece 4 comprises a glue layer, the glue layer is fixedly bonding to the bottom surface 12 of the hollow frame 1. The inner fixing member 42 of the elastic damping piece 4 also comprises a glue layer, the glue layer is fixedly bonding to the bottom edge 32 of the voice coil 3. Similarly, the outer end 51 of the symmetrical damping piece 5 comprises a glue layer, the glue layer is fixedly bonding to the bottom surface 12 of the hollow frame 1. The inner end 52 of the symmetrical damping piece 5 comprises a glue layer, the glue layer is fixedly bonding to the bottom edge 32 of the voice coil 3. Therefore, the elastic damping piece 4 and the symmetrical damping piece 5 are fixed by gluing. In other embodiments, the elastic damping piece 4 and the symmetrical damping piece 5 are fixed at the bottom surface 12 of the hollow frame 1 and the bottom edge 32 of the voice coil 3 by hot melting, ultrasonic welding, engaging, clamping, etc.

In the assembly process, the diaphragm 2 and the hollow frame 1 may be fixed first. Next, after the voice coil 3 is placed in the predetermined position of the hollow frame 1 (i.e. the hollow portion 10 of the hollow frame 1), the glue layer is coated on the outer fixing member 41 and the inner fixing member 42 of the elastic damping piece 4, and the glue layer is also coated on the outer end 51 and the inner end 52 of the symmetrical damping piece 5. Then, the elastic damping piece 4 and the symmetrical damping piece 5 are aligned with and attached to the hollow frame 1 and the voice coil 3, to achieve the assembly of the elastic damping piece 4 and the symmetrical damping piece 5 on the hollow frame 1.

In other embodiments, the glue layer is coated on the bottom surface 12 of the hollow frame 1 and the bottom edge 32 of the voice coil 3. Then, the elastic damping piece 4 and the symmetrical damping piece 5 are aligned with and attached to the hollow frame 1 and the voice coil 3.

Please refer to FIGS. 2 to 4. In this embodiment, the micro-speaker 100 further comprises a base 6. The base 6 has a plurality of holding elements 601, 602, 603, 604. The holding elements 601, 602, 603, 604 are respectively fixedly connected to the hollow frame 1. A sheet structure is formed by stamping and then four edges of the sheet structure are bent upwardly to form the holding elements 601, 602, 603, 604. As shown in FIGS. 2 and 4, in this embodiment, the holding elements 601, 602, 603, 604 are held between the hollow frame 1 and the voice coil 3. In other embodiments, the holding elements 601, 602, 603, 604 are fitted over the hollow frame 1.

Furthermore, as shown in FIGS. 2 and 3, the base 6 is provided with a plurality of ventilation holes 611, 612, 613, 614 respectively corresponding to the four corners of the rectangular hollow frame 1, so as to release air pressure during the vibration of the diaphragm 2. The ventilation holes 611, 612, 613, 614 are formed by having the holding elements 601, 602, 603, 604 with shorter lengths. Hence, when portions of the base 6 are bent upwardly to form the holding elements 601, 602, 603, 604, the ventilation holes 611, 612, 613, 614 can be formed between every adjacent two of the holding elements 601, 602, 603, 604 accordingly. Furthermore, the ventilation holes 611, 612, 613, 614 respectively correspond to the elastic piece body 43 of the elastic damping piece 4 or the damping piece body 53 of the symmetrical damping piece 5, to provide the deformation spaces for the bending portion 431 of the elastic piece body 43 and the bending portion 531 of the damping piece body 53.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A micro-speaker, comprising:

a hollow frame comprising a hollow portion, a top surface, and a bottom surface opposite to the top surface, wherein the hollow portion communicates between the top surface and the bottom surface;

a diaphragm comprising an outer peripheral portion and a central portion, wherein the outer peripheral portion surrounds the central portion, the outer peripheral portion covers the top surface of the hollow frame;

a voice coil coaxially held in the hollow portion of the hollow frame, wherein the voice coil comprises a top edge and a bottom edge opposite to the top edge, and the top edge is fixedly connected to the central portion of the diaphragm;

an elastic damping piece comprising an outer fixing member, an inner fixing member, and an elastic piece body, wherein the outer fixing member is fixedly connected to the bottom surface of the hollow frame, the inner fixing member is fixedly connected to the bottom edge of the voice coil, and the elastic piece body is connected between the outer fixing member and the inner fixing member;

a first symmetrical damping piece, wherein the first symmetrical damping piece is arranged at the rectangular hollow frame, wherein the first symmetrical damping piece comprises a first outer end, a first inner end, and a first damping piece body; the first outer end is fixedly connected to the bottom surface of the hollow frame, the first inner end is fixedly connected to the bottom edge of the voice coil, and the first damping piece body is connected between the first outer end and the first inner end;

a second symmetrical damping piece, wherein the second symmetrical damping piece is arranged at the rectangular hollow frame, wherein the second symmetrical damping piece comprises a second outer end, a second inner end, and a second damping piece body; the second outer end is fixedly connected to the bottom surface of the hollow frame, the second inner end is fixedly connected to the bottom edge of the voice coil, and the second damping piece body is connected between the second outer end and the second inner end;

a third symmetrical damping piece, wherein the third symmetrical damping piece is arranged at the rectangular hollow frame, wherein the third symmetrical damping piece comprises a third outer end, a third inner end, and a third damping piece body; the third outer end is fixedly connected to the bottom surface of the hollow frame, the third inner end is fixedly connected to the bottom edge of the voice coil, and the third damping piece body is connected between the third outer end and the third inner end; and a magnetic circuit assembly held in the hollow portion of the hollow frame, wherein the magnetic circuit assembly is in the voice coil but not in contact with the voice coil;

wherein, the first outer end is connected to the outer fixing member, the first inner end is connected the second inner end, the second outer end is connected the third outer end, the third inner end is connected the inner fixing member, wherein the inner fixing member is not connected the first inner end, the second inner end is not connected the third inner end, so that the first symmetrical damping piece, the second symmetrical damping piece, the third symmetrical damping piece and the elastic damping piece are connected as a single annular structure.

2. The micro-speaker according to claim 1, wherein the elastic piece body of the elastic damping piece comprises a bending portion, an extension length of the bending portion is greater than a linear distance between the outer fixing member and the inner fixing member.

3. The micro-speaker according to claim 2, wherein the bending portion is a U-shaped elastic piece body.

4. The micro-speaker according to claim 1, wherein the outer fixing member of the elastic damping piece comprises a glue layer, the glue layer is fixedly bonding to the bottom surface of the hollow frame.

5. The micro-speaker according to claim 1, wherein the inner fixing member of the elastic damping piece comprises a glue layer, the glue layer is fixedly bonding to the bottom edge of the voice coil.

6. The micro-speaker according to claim 1, wherein the hollow frame is a rectangular frame or a circular frame.

7. The micro-speaker according to claim 1, further comprising a base, wherein the base comprises a plurality of holding elements, the holding elements are fixedly connected the hollow frame, respectively, and the base has a plurality of ventilation holes and one of the ventilation holes corresponds to the elastic piece body of the elastic damping piece.

* * * * *